US006515254B2

(12) United States Patent
Beck et al.

(10) Patent No.: US 6,515,254 B2
(45) Date of Patent: Feb. 4, 2003

(54) METHOD FOR THE SURFACE TREATMENT OF A TRIBOLOGICAL COATING

(75) Inventors: Markus Beck, Ulm (DE); Tilmann Haug, Uhldingen-Muhlhof (DE); Patrick Izquierdo, Ulm (DE); Michael Lahres, Ulm (DE); Peter Linden, Beimerstetten (DE); Matthias Merkel, Wooster, OH (US); Harald Pfeffinger, Tiefenbronn (DE)

(73) Assignee: DaimlerChrysler AG, Stuttgart (DE)

( * ) Notice: Subject to any disclaimer, the term of this patent is extended or adjusted under 35 U.S.C. 154(b) by 53 days.

(21) Appl. No.: 09/849,828

(22) Filed: May 7, 2001

(65) Prior Publication Data

US 2001/0023859 A1 Sep. 27, 2001

Related U.S. Application Data

(63) Continuation of application No. 09/389,388, filed on Sep. 3, 1999, now abandoned.

(30) Foreign Application Priority Data

Sep. 3, 1998 (DE) ..... 198 40 118
May 28, 1999 (DE) ..... 199 24 494

(51) Int. Cl.[7] ..... B23K 26/00; B24B 1/00; B05D 3/12

(52) U.S. Cl. ..... 219/121.69; 219/121.47; 427/357; 451/28; 451/54; 29/888.061

(58) Field of Search ..... 219/121.47, 121.66, 219/121.65, 121.68, 121.69; 427/357; 451/28, 54; 29/888.06, 888.061

(56) References Cited

U.S. PATENT DOCUMENTS 4,212,602 A * 7/1980 Buran et al.
5,131,356 A * 7/1992 Sick et al.
5,328,304 A 7/1994 Kress et al.
5,441,439 A * 8/1995 Grimm et al.
5,648,620 A * 7/1997 Stenzel et al.
5,829,405 A * 11/1998 Godel

FOREIGN PATENT DOCUMENTS

| | | |
|---|---|---|
| DE | 4334497 | 5/1995 |
| DE | 195 08 687 | 10/1995 |
| DE | 44 38 550 | 5/1996 |
| DE | 197 33 204 A1 | 2/1999 |
| DE | 197 33 205 A1 | 2/1999 |
| EP | 0 565742 A1 | 4/1992 |
| EP | 0 559328 A2 | 9/1993 |
| EP | 565 742 A1 | 10/1993 |
| JP | 6-101064 | 4/1994 |
| JP | 8-27559 | 1/1996 |
| JP | 8-264187 | 10/1996 |

OTHER PUBLICATIONS

William Young, U.S. patent application S.N. 07/870,071, filed Apr. 17, 1992 and made available upon publication of JP 8–101064 on Apr. 12, 1994.

Pfeiffer; F.: Höhere Sphären, IN: Maschinenmarkt, Würzburg 101(1995) 52, Seiten 46 bis 49.

"Hartdrehen statt Feinschleifen", IN: Industrieanzeiger 34–35/97, Seite 48 (siehe Gelbmarkierungen).

"Hartdrehen überholt Feinschleifen", IN: maschine and werkzeug 6/95, Seiten 57 bis 61.

* cited by examiner

*Primary Examiner*—Samuel M. Heinrich
(74) *Attorney, Agent, or Firm*—Crowell & Moring LLP

(57) ABSTRACT

A method for surface working a tribological coating of a supereutectic aluminum-silicon alloy or an aluminum-silicon composite material with a coating structure includes machining the surface dry, without lubricant, in a one-step process, with a cutting tool having a cutting material containing diamond. The surface treating may be followed by a one-step finish honing or one-step texturing process.

21 Claims, 3 Drawing Sheets

METHOD FOR THE SURFACE TREATMENT OF A TRIBOLOGICAL COATING

This application is a continuation of application Ser. No. 09/389,388, filed Sep. 3, 1999 now abandoned.

BACKGROUND AND SUMMARY OF THE INVENTION

The present invention relates to a method for the surface treatment of a tribological coating made of a supereutectic aluminum-silicon alloy and an aluminum-silicon laminate with a coating structure wherein the surface is reworked after the coating is produced.

Methods for the treatment of supereutectic aluminum-silicon alloys are known in themselves. These alloys serve especially for the production of workpieces with surfaces of wear-resistant, low-friction tribological coatings. Such workpieces and coatings are used, for example, in automobile manufacture to produce internal friction surfaces in crankcases and cylinder liners.

Present-day light construction crankcases for piston machines consist, for cost reasons, of subeutectic aluminum-silicon alloys which are made by pressure casting. This material, however, does not provide satisfactory friction and wear qualities. Cylinder liners or at least their interior friction surfaces must therefore consist of a wear-resistant, low-friction, tribological material.

DE 44 38 550 A1 has disclosed a cylinder liner made from a supereutectic aluminum-silicon alloy which has fine silicon primary crystals and intermetallic phases in the form of hard particles. Such a material must then still be surface-treated: first a fine boring is performed, and then the surface is smoothed by honing. This takes place in series production in at least two working steps which are called "pre-honing" and "finish honing." In a final step the silicon particles contained in the alloy, which form the actual friction surface, are exposed by etching the aluminum away with an aqueous solution of an acid.

EP 0 565 742 A1 has disclosed a honing process for refining workpiece surfaces in at least two steps. In one of the process steps the surface of the workpiece is finish-honed to the final dimension. Thus a very finely honed texture is produced in the surface. In another process step, which can be performed before or after the finish honing, striations intersecting one another are produced by a radiation apparatus, especially a laser. The final surface in this case has both honing striations and laser radiation traces.

Another possibility consists in coating the internal friction surfaces of the cylinder liners after the crankcase has been cast. This is accomplished, for example, by plasma spraying as described in DE 195 08 687 C2. By this method a layer of iron or steel alloy can be applied which is characterized by satisfactory friction and wear qualities.

German patent applications 197 33 204.8-45 and 197 33 205.6-45, which have an earlier priority but are not yet published, filed on Aug. 1, 1997, a hot-sprayed coating of a supereutectic aluminum-silicon alloy and aluminum-silicon composite is disclosed which is characterized by a heterogenic coating structure of a solid solution of aluminum, a coarse to very fine network of eutectic silicon, silicon segregations and particles, intermetallic phases and extremely finely divided oxides. This coating contains characteristic primary aluminum solid solution dendrites in which the dendrite arms are enveloped in eutectic silicon. The photomicrographs of such coatings show a characteristic sponge-like appearance. Silicon primary segregations and silicon particles are present only in a small percentage and have a small diameter. In the surface treatment of these coatings, the dendrite arms at the surface are lightly ground, so that in the exposure that follows the aluminum is etched away and the aluminum-free silicon structures remain, which form the actual friction surface.

The surface treatment of supereutectic aluminum-silicon coatings, regardless of their composition and structure, is nevertheless very complicated. Lubricants must be used which then in some cases must first be completely removed again before the hard particles are exposed.

The present invention is therefore addressed to the problem of devising a method of the kind referred to above which will be less complicated and less costly.

The solution is to finish the surface by machining it dry, without lubricant, in a one-step procedure, using a cutting tool with at least a diamond-containing cutting material.

The idea of the invention thus consists in replacing the conventional, complicated wet treatment such as honing, for example, with a dry finishing process in which a cutter with at least a diamond-containing cutting material is used. Surprisingly it was found that the quality of a surface treated by the method of the invention is comparable with the quality of a honed surface and may even be better.

Advantageous embodiments are to be seen in the subordinate claims. The cutting tool can be single-edged or multiple-edged. Suitable cutting tools are, for example, an indexable cutting tip or a cutter spindle equipped with a plurality of indexable cutting tips. Coated bores, such as cylinder liners with a friction surface coating, are preferably reworked by dry spindle cutting. The tool with one or more cutters, such as a cutting spindle equipped with one or more indexable cutting tips, is introduced into the standing, internally coated cylinder liner. The cutting is performed without coolant or under minimal lubrication conditions. Vice versa, it is of course also possible for the workpiece to be driven while a fixed tool is used.

Suitable cutting materials are, for example, polycrystalline diamond, monocrystalline diamond, or a carbide coated with a vapor-deposited diamond layer.

Hard components can be contained in the structure of the tribological coating. These are, as a rule, hard, primary and eutectic silicon particles. The hard coating components at the surface can be exposed immediately after the dry machining.

Another advantageous embodiment provides for the use of a combination of dry machining and an additional procedure wherein after the dry machining the surface is textured in a one-step process by irradiation, especially with radiation grooving. Preferably a laser texturizing of the surface is performed. This laser texturizing can advantageously be limited in the case of cylinder friction surfaces to the area of the top dead center, that is, the point at which the direction of the movement of the piston reverses and its velocity is zero. The laser texturization creates pockets in the surface in which lubricant can collect later on during operation. This solution is a combination process combining the dry cutting operation with a subsequent operation for texturing the surface by means of a beam. The final surface in this case has both a dry-cut striated texture produced with a specifically shaped cutter or cutters, on which beam grooving is superimposed.

BRIEF DESCRIPTION OF THE DRAWINGS

The coating to be treated is preferably a coating produced by plasma spraying methods. A preferred aluminum-silicon alloy is substantially copper-free, i.e., it contains less than 1% copper by weight.

An embodiment of the present invention will now be described in connection with the appended photographs.

DETAILED DESCRIPTION OF THE PREFERRED EMBODIMENTS

To prepare a coating of supereutectic aluminum-silicon alloy, any aluminum-silicon alloy can be used, such as AlSi25 Ni4 1.2 Fe 1.2 Mg, 0.6 Cu. The alloy may also contain solid lubricants such as hexagonal boron nitride, titanium dioxide, molybdenum sulfide and others.

Especially preferred are plasma-sprayed coatings of supereutectic aluminum-silicon alloys and supereutectic aluminum-silicon composite materials such as those described below.

Embodiment 1

A supereutectic aluminum-silicon alloy was used, having the following composition:

Alloy A:

Silicon: 23.0 to 40.0 wt.-%, preferably about 25 wt.-%
Magnesium: 0.8 to 2.0 wt.%-%, preferaabout about 1.2 wt.-%
Zirconium: maximum 0.6 wt.-%
Iron: maximum 0.25 wt.-%
Manganese, nickel, copper and zinc: maximum 0.01 wt.-% each
Balance: aluminum.

A spray powder was prepared from this alloy, and a coating thereof was applied by plasma spraying to the cylindrical friction surface of a cylinder liner made of subeutectic aluminum-silicon alloy. The cylinder liner has a diameter of 88 cm, a length of 150 mm and a wall thickness of 5 mm.

Figure 1:
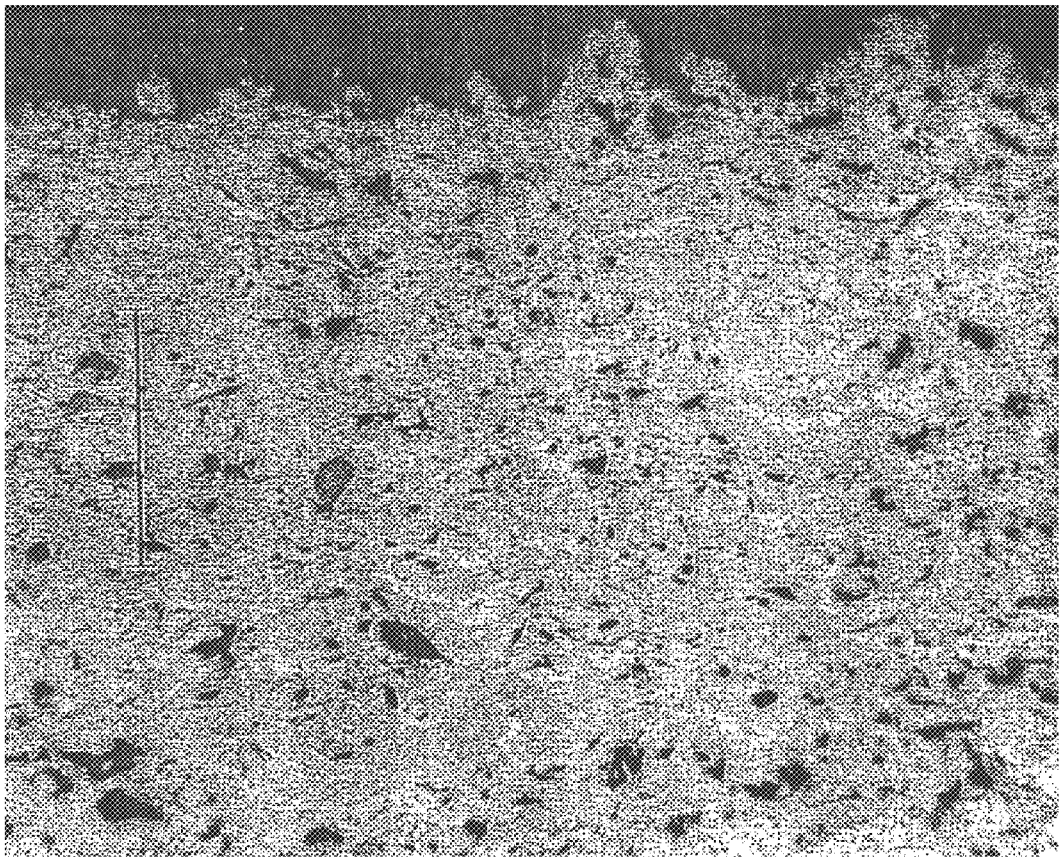
FIG. 1 is a photomicrograph of a coating applied by plasma spraying a substantially copper-free, supereutectic aluminum-silicon alloy before the surface treatment.

The coating before machining is represented in FIG. 1. The typical spongy structure is clearly to be seen. It is to be attributed to the formation of aluminum solid-solution dendrites whose arms are enveloped in a coating of eutectic silicon. Also seen are small primary silicon segregations.

The condition of the surface of the coating was characterized as follows:

$R_{max}$=21.5 μm; $R_t$=24.2 μm; $R_z$=17.7 μm; $R_a$=3.5 μm.

An indexable cutter tip with a cutting material of polycrystalline diamond of type TCMW 16 T3 08 F (CDIO) was chosen as the machining tool. The tool was of type Tizit NVR 16-3. For the dry fine turning the following parameters were established: feed=0.021 m/min; $V_c$=158.42 m/min; n=575 $min^{-1}$; $a_p$=0.05.

Figure 2:
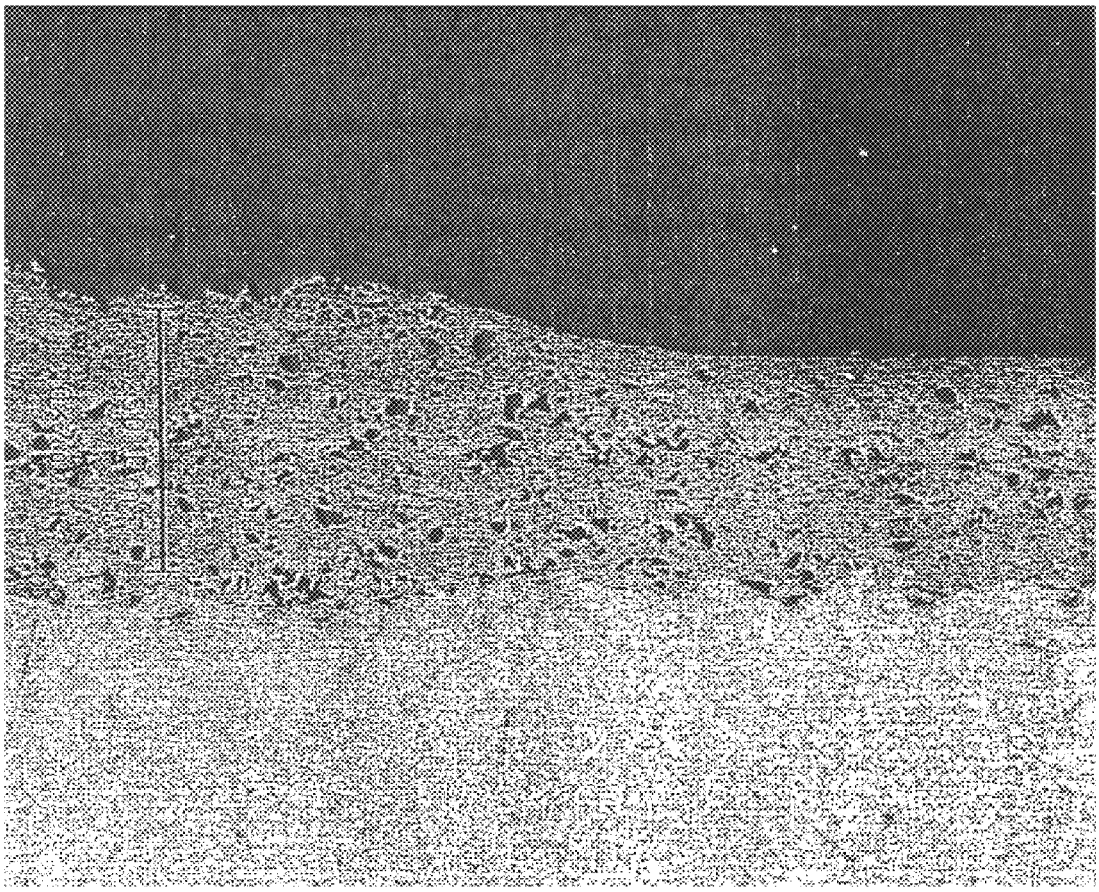
FIG. 2 shows the same coating after the dry machining with an indexable cutter tip of polycrystalline diamond (right) and an unmachined area (left)
Figure 3:
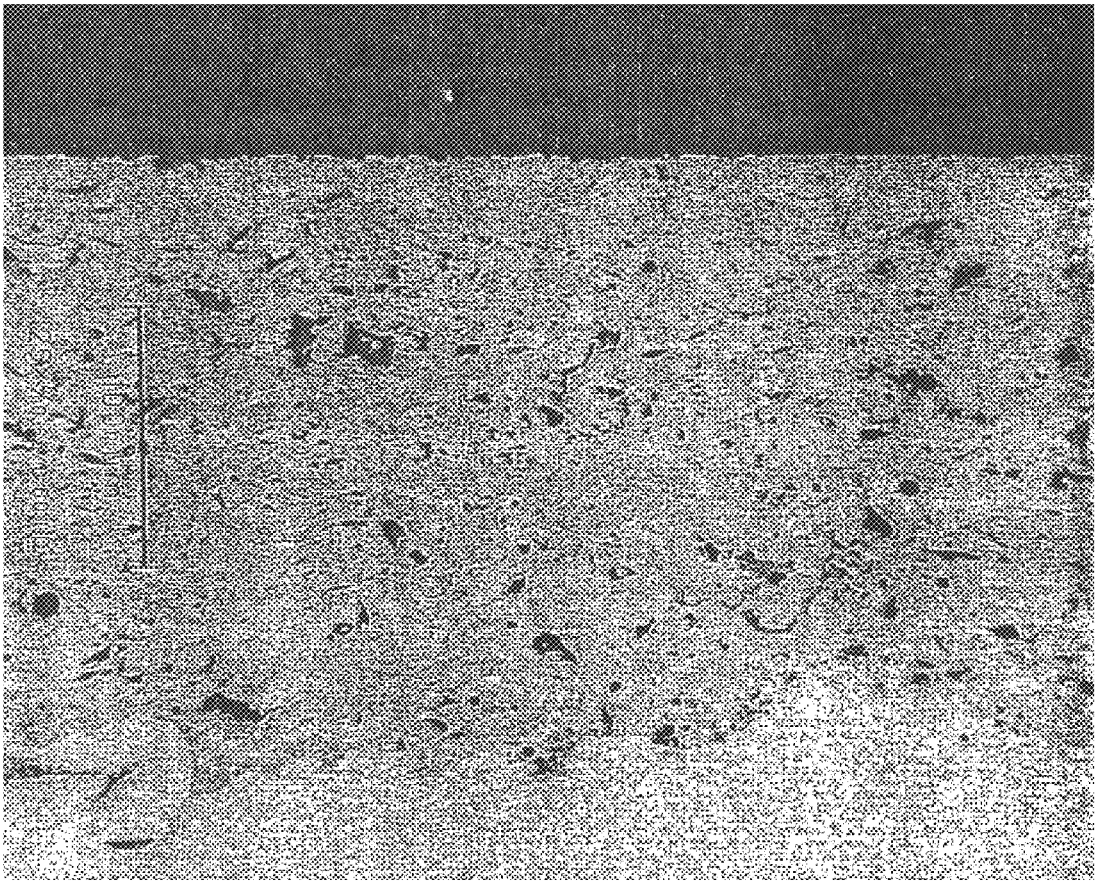
FIG. 3 shows the same coating as FIG. 2, but completely machined.

FIG. 2 is a photomicrograph of the surface thus machined. The surface quality after being machined dry was able to be characterized as follows:

$R_{max}$=0.98 μm; $R_t$=0.99 μm; $R_z$=0.84 μm; $R_a$=0.125 μm.

These values are better than those achievable by conventional honing.

The following alloy can also be used, and can be reworked as described above, resulting in comparably good results:

Alloy B:

Silicon: 23.0 to 40.0 wt.-%, preferably about 25 wt.-%
Nickel: 1.0 to 5.0 wt.%-%, preferably about 4 wt.-%
Iron: 1.0 to 1.4 wt.%-%, preferably about 1.2 wt.-%
Magnesium: 0.8 to 2.0 wt.%-%, preferably about 1.2 wt.-%
Zirconium: maximum 0.6 wt.-%
Manganese, copper and zinc: maximum 0.01 wt.-% each
Balance aluminum.

Composite materials produced by plasma spraying using a special spray powder can likewise be used. This spray powder is an agglomerated composite of fine silicon particles and fine metal particles of at least one aluminum-silicon alloy which are bonded together with the aid of inorganic or organic binders. The silicon particle content amounts to 5 to 95 wt.%-%, the content of alloy particles is 95 to 50 wt.-% The silicon particles have an average grain size of 0.1 to 10 μm, preferably about 5 μm.

The alloy particles have an average grain size of 0.1 to 50 μm, preferably about 5 μm.

The alloy particles consist preferably of a mixture of subeutectic alloy particles and supereutectic alloy particles. Through the use of supereutectic alloy particles the content of aluminum mixed crystal in the coating structure is maintained, while the formation of the aluminum mixed crystal is suppressed by the use of subeutectic alloy particles. Two examples of appropriate subeutectic and supereutectic alloys are given below.

Subeutectic alloys:

Alloy 1

Silicon: 0 to 11.8 wt.%-%, preferably about 9 wt.-%
Iron: maximum 0.25 wt.-%
Magnesium: 0.8 to 2.0 wt.%-%, preferably about 1.2 wt.-%
Zirconium: maximum 0.6 wt.-%
Manganese, nickel, copper and zinc: maximum 0.01 wt.-% each
Balance aluminum.

Alloy 2

Silicon: 0 to 11.8 wt.%-%, preferably about 9 wt.-%
Nickel: 1.0 to 5.0 wt.%-%, preferably about 4 wt.-%
Iron: 1.0 to 1.4 wt.%-%, preferably about 1.2 wt.-%
Magnesium: 0.8 to 2.0 wt.%-%, preferably about 1.2 wt.-%
Zirconium: maximum 0.6 wt.-%
Manganese, copper and zinc: maximum 0.01 wt.-% each
Balance aluminum.

Supereutectic alloys:

Alloy 3:

Silicon: 11.8 to 40.0 wt.-%, preferably about 17 wt.-%
Iron: maximum 0.25 wt.-%
Magnesium: 0.8 to 2.0 wt.-%, preferably about 1.2 wt.-%
Zirconium: maximum 0.6 wt.-%
Manganese, copper, nickel and zinc: maximum 0.01 wt.-% each
Balance aluminum.

Alloy 4:

Silicon: 11.8 to 40.0 wt.-%, preferably about 17 wt.-%
Nickel: 1.0 to 5.0 wt.%-%, preferably about 4 wt.-%
Iron: 1.0 to 1.4 wt.%-%, preferably about 1.2 wt.-%
Magnesium: 0.8 to 2.0 wt.-%, preferably about 1.2 wt.-%
Zirconium: maximum 0.6 wt.-%
Manganese, copper and zinc: maximum 0.01 wt.-% each
Balance aluminum

What is claimed is:

1. A method for treating a surface of a tribological coating comprising a supereutectic aluminum-silicon alloy or an aluminum-silicon composite material, said method comprising dry machining the surface in a single-step with a cutting tool having at least one diamond-containing cutting material.

2. A method according to claim 1, wherein the cutting tool is a single-edge cutting tool.

3. A method according to claim 2, wherein the cutting tool is an indexable insert.

4. A method according to claim 1, wherein the cutting tool comprises a multi-edged cutting tool.

5. A method according to claim 4, wherein the cutting tool comprises a cutting spindle having a plurality of indexable inserts.

6. A method according to claim 1, wherein the at least one diamond-containing cutting material is selected from the group consisting of polycrystalline diamond, monocrystalline diamond, carbide coated with a chemically-vapor-deposited diamond layer, and mixtures thereof.

7. A method according to claim 1, further comprising, after said dry machining, exposing hard coating components contained in the coating and lying at the machined surface.

8. A method according to claim 1, further comprising, after said dry machining, finish-honing the surface in a one-step process.

9. A method according to claim 1, further comprising, after said dry machining, texturing the surface in a one-step process by irradiation.

10. A method according to claim 9, wherein said irradiation is by a laser.

11. A method according to claim 9, wherein said irradiation comprises radiation grooving.

12. A method according to claim 1, wherein the surface is a cylinder friction surface of a crankcase for a piston machine.

13. A method according to claim 12, wherein the cylinder friction surface is treated only in an area of the top dead center and, further comprising exposing hard coating components lying in the cylinder friction surface in said area.

14. A method according to claim 1, wherein the coating is produced by plasma spraying.

15. A method according to claim 1, wherein the coating is produced from a supereutectic aluminum-silicon alloy or a supereutectic aluminum-silicon composite material having a copper content less than 1 wt.-%.

16. A method according to claim 15, wherein the copper content is less than 0.1 wt.-%.

17. A method according to claim 15, wherein the copper content is less than 0.01 wt.-%.

18. A method according to claim 1, wherein an alloy used to produce the coating comprises:

a heterogenic coating structure of a primary aluminum solid solution;

a coarse to very fine network of eutectic silicon;

primary silicon segregations having an average size of less than 10 $\mu$m; and intermetallic phases having an average size of less than 5 $\mu$m.

19. A method according to claim 18, wherein the intermetallic phases comprise $Mg_2Si$ and oxides.

20. A method according to claim 1, wherein a composite material used to produce the coating comprises:

a heterogeneous coating structure of a primary aluminum solid solution;

a coarse to very fine network of eutectic silicon;

at least one of primary silicon segregations or embedded silicon particles having an average size of less than 10 $\mu$m; and intermetallic phases having an average size of less that 5 $\mu$m.

21. A method according to claim 20, where the intermetallic phases comprise $Mg_2Si$ and oxides.

* * * * *